United States Patent [19]

Griffin

[11] 3,952,680

[45] Apr. 27, 1976

[54] ROLL STABILIZER FOR VESSELS AT REST

[76] Inventor: Edward N. Griffin, 213 S. Pacific, No. C, Oceanside, Calif. 92054

[22] Filed: Sept. 30, 1974

[21] Appl. No.: 510,241

[52] U.S. Cl. ..... 114/123; 114/122

[51] Int. Cl.[2] ..... B63B 43/14

[58] Field of Search ..... 114/123, 122, 121, 126, 114/209, 66.5 H; 9/1 R

[56] References Cited

UNITED STATES PATENTS

| | | | |
|---|---|---|---|
| 1,709,219 | 4/1929 | Hille | 114/123 |
| 1,773,999 | 8/1930 | Haight | 114/123 |
| 2,108,574 | 2/1938 | Atwell | 114/126 |
| 3,029,767 | 4/1962 | Donnan | 114/209 |
| 3,260,232 | 7/1966 | Douglas | 114/126 |
| 3,295,487 | 1/1967 | Smith | 114/66.5 H |

FOREIGN PATENTS OR APPLICATIONS

| | | | |
|---|---|---|---|
| 881,453 | 5/1953 | Germany | 114/126 |

*Primary Examiner*—Trygve M. Blix
*Assistant Examiner*—Charles E. Frankfort
*Attorney, Agent, or Firm*—Brown & Martin

[57] ABSTRACT

A stabilizer for reducing the amount of roll motion induced by ocean swells in a vessel drifting or at anchor. A stabilizer arm is pivotally mounted about a horizontal axis on the deck of the vessel and supports a stabilizer disc at its outer end. The disc has sufficient buoyancy so that it is self positioning at the surface of the water, but at the same time is sufficiently submerged to be fully effective. The disc constantly adjusts its relative angular position to the vessel through the pivotal interconnection. As the vessel is exposed to the force of a swell that would tend to cause the vessel to roll, the disc is pushed or pulled through the water. The drag force on the disc is in opposition to the force tending to cause the vessel to roll.

13 Claims, 5 Drawing Figures

ROLL STABILIZER FOR VESSELS AT REST

BACKGROUND OF THE INVENTION

The problem of stabilizing vessels at sea (or in larger inland bodies of water) particularly for the purpose of increasing the comfort of passengers has been investigated for many years. Most of these investigations, and the apparatus resulting therefrom, were attempts to reduce the vessel's roll. Roll motion is generally considered to be the easiest to control without affecting the overall hydro-dynamic performance of the vessel and tends to have the maximum undesirable effects on individuals being carried on the vessel. Most of these prior inquiries dealt with the problem of roll stability of vessels underway. Such things as hydraulic stabilizers that move water from one side of the vessel to the other to counteract the vessels tendency to roll under the inducement of swells have been developed and put into use. Also hydro-dynamic fins have been utilized that use the force of the vessel underway to produce an upward or downward lift opposite the direction of the roll tendency.

Relatively little attention has been directed to the problem of vessel roll while the vessel is at rest. In certain marine operations, for example in still fishing, where the vessel is at rest (at anchor or drifting with the surface currents) the tendency of the ocean swells to produce rolling is of sufficient magnitude that many persons experience motion discomfort. In addition, such rolling motion is objectionable for crewmembers who are attempting to carry out operations on such vessels, such as the placement of fishing poles, and such motion inhibits free movement about the vessel. The problem is particularly acute in many personal fishing vessels which vessels have a relatively narrow beam and therefore are subject to larger induced roll magnitudes.

Float type stabilizers that are on outriggers have a limited tendency to reduce the roll of a vessel but only to the extent that they would tend to reduce overroling; that is the tendency of a vessel to roll beyond the inclination of the water surface itself. However, since such devices are rigidly interconnected with the vessel they cannot prevent the inclination of the vessel as a swell approaches and passes. They require an excessively large float area to achieve a significant stabilization effect. Such devices cannot easily be retracted when the vessel is underway. Various fins, skegs and other protrusions from the underside of the vessel's hull have been incorporated in an attempt to increase roll resistance. However, such devices cannot overcome rolling due to harmonic effects (the tendency of certain swell frequencies to produce a disproportionate effect) because they move in sychronization with the vessel itself. Further, such surfaces must be excessively large (due to their short lever arm) to accomplish any substantial stabilizing effect.

Accordingly it is desirable to have a roll stabilizer for vessels at rest which is relatively small in size and uncomplicated in operation and which substantially reduces the roll magnitude of swell induced rolling. Such a device is especially desirable where it is self adjusting and easily retractable for operations underway.

SUMMARY OF THE INVENTION

In an exemplary embodiment of the invention the deficiencies of prior art roll stability systems are overcome by a device that incorporates a stabilizer disc. As utilized herein the term disc is intended to mean a substantially planar element having a substantial planar area whether it is of circular or other exterior configuration. The stabilizer disc is held in an appropriate angular orientation to the surface of the water by a stabilizer arm, which arm is pivotally connected to the vessel by a pivot connection secured to the deck of the vessel or other appropriate structure. While other angulations are within the scope of the invention, it has been found to be desirable to orient the plane of the stabilizer disc at right angles to the stabilizer arm.

The relative size relationship between the distance from the stabilizer disc to the pivot and the distance from the pivot to the water line of the vessel is an important parameter in the operation of the system. A wide range of disc-to-pivot vs. pivot-to-water line ratios have been found to produce satisfactory results, the ratio of two-to-one has been found to be particularly advantageous.

The selection of materials and attachments to the stabilizer disc are made in a manner to produce a net buoyancy for the stabilizer disc that will cause a major portion of the stabilizer disc to be submerged in normal operation. A buoyancy that produces a stabilizer disc that is three-quarters submerged in normal operation has been found to be optimum. The residual buoyancy has the effect of maintaining the stabilizer disc at the surface of the water and therefore maintains the disc in the appropriate position for stabilization without the necessity of supporting structure extending from the vessel. The stabilizer arm is the only necessary load transfer structure and may be relatively light in weight since the pivoting action reduces bending moments and shear stresses that otherwise would have to be transferred. The loads are all substantially tension or compression.

It has been found that in some applications that the additional stability of a line running from the stabilizer disc to the bow of the vessel enhances the overall strength of the system, particularly if it is desired to operate the stabilizer with the vessel underway, such as during trolling.

The drag of the stabilizer disc is effective both as it is pulled by the vessel and as it is pushed through the water by a roll in the opposite direction. Accordingly, a single stabilizer may be incorporated, however in the typical application, two such stabilizer discs are mounted on opposite sides of the vessel to increase the effective roll stability.

It is therefore an object of the invention to provide a new and improved roll stabilizer for vessels at rest.

It is another object of the invention to provide a new and improved roll stabilizer that does not require expensive structural members.

It is another object of the invention to provide a new and improved roll stabilizer that transmits forces in tension and compression.

It is another object of the invention to provide a new and improved roll stabilizer that has a low manufacturing cost.

It is another object of the invention to provide a new and improved roll stabilizer that is easily retracted for operation of the vessel underway.

It is another object of the invention to provide a new and improved stabilizer that is self-adjusting.

Other objects and many attendant advantages of the invention will become more apparent upon a reading of the following detailed description, together with the drawings in which like reference numerals refer to like parts throughout and in which:

FIG. 1 is a top plan view of a typical vessel with the stabilizers attached.

FIG. 2. is a front veiw of the vessel.

Figure 1:
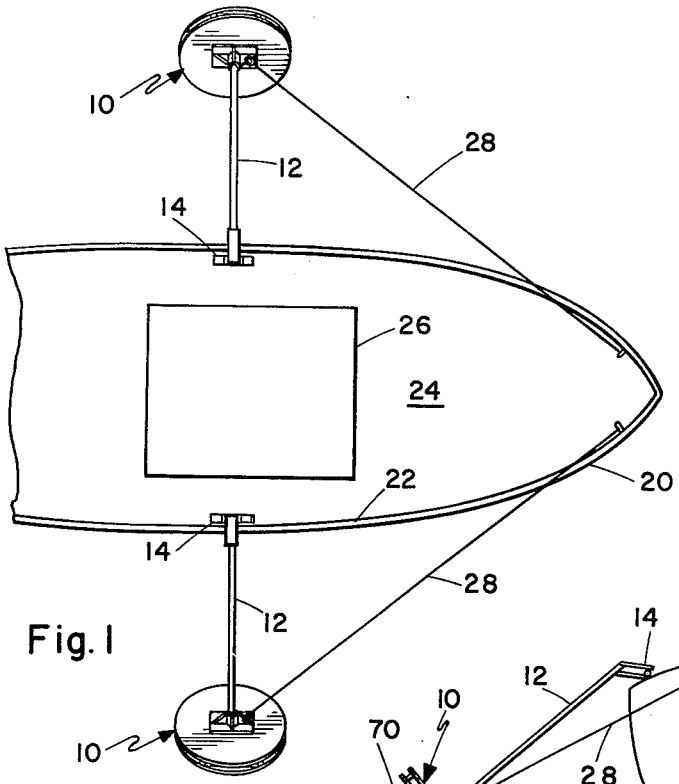

Referring now to the drawings, there is illustrated the roll stabilizer of the invention including the stabilizer disc 10, stabilizer arm 12 and pivot structure 14. In the exemplary embodiment the stabilizer disc is comprised of two generally planar circular elements 15 and 17. The circular elements are spaced by spacer blocks 16 which run generally aligned with the fore and aft direction in the vessel. This configuration has been discovered to produce a maximized roll stabilizing effect. The increase in roll stabilizing effect is presumed to come from the doubling of the surface area which is made effective by the access of the water along the longitudinal dimension between the spacer blocks 16.

Figure 2:
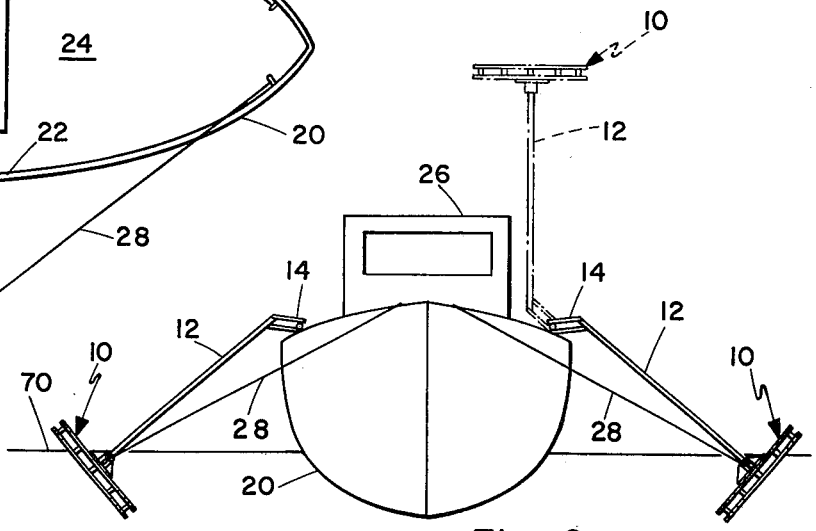

The stabilizer arm includes a clearance section 18 at the end of the stabilizer arm connected to the pivot 14. The clearance section 18 provides for substantial pivoting range of the stabilizer arm and stabilizer disc without conflicting with the hull structure of the vessel 20. Thus, the clearance section 18 permits the pivot 14 to be mounted spaced inboard from the rail 22 and on the generally horizontal deck portion 24, this facilitates installation and minimizes interference with lines and other structure which may be drawn along the rail, such as when the vessel is tied up at dock and the stabilizer in the retracted position. The retracted position of the stabilizer is shown in broken lines in FIG. 2, which illustrate the manner in which the stabilizer is rotated to a substantially vertical orientation, and wherein the stabilizer disc is vertically above the deck house or other deck structure 26.

Referring now to FIG. 1, the placement of two stabilizer discs 10 on opposite sides of the vessel 20 is illustrated. The preferred placement of the pivots 14 is substantially amidships of the vessel which position minimizes the tendency of the stabilizer to introduce other motions into the vessel during stabilizer operation. However, acceptable operation can be obtained over a range of fore and aft positions of the pivots 14. FIG. 1 also illustrates the use of bow lines 28 which are secured to the stabilizer discs 10 at one end thereof and to structure on the vessel 20 substantially near the bow thereof. Such lines enhance the structural integrity of the stabilizer disc during stabilizing operations, and are particularly effective in minimizing stresses on the pivot structure and stabilizer during operation of the stabilizer with the vessel underway, such as might be encountered in trolling operations for fishing.

Figure 3:
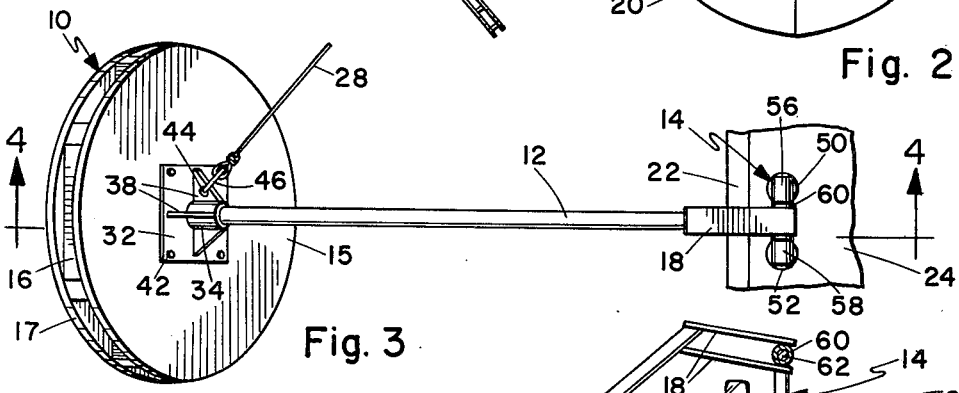
FIG. 3 is an enlarged top plan view of one stabilizer assembly.
Figure 4:
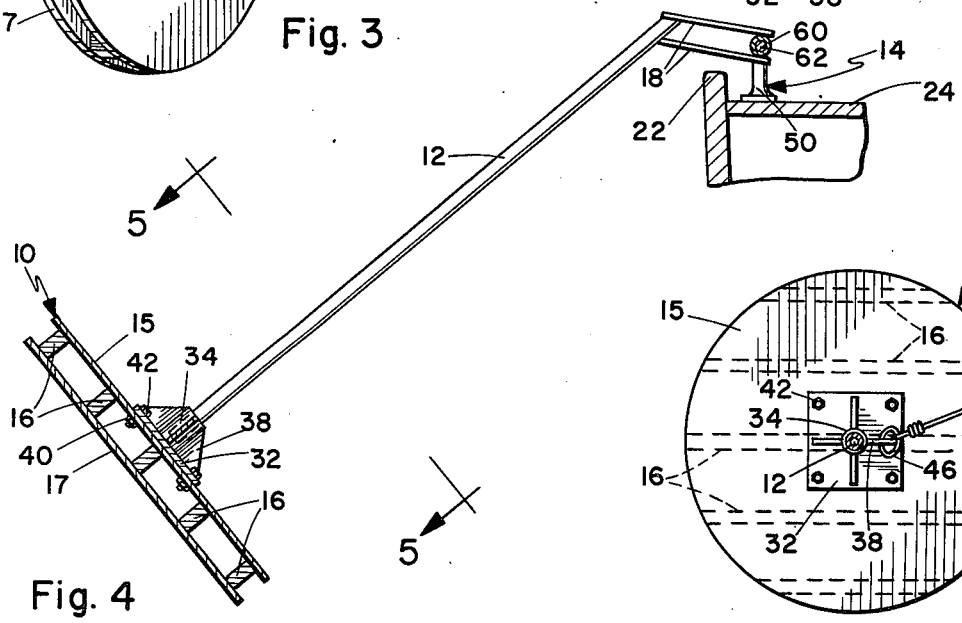
FIG. 4 is a sectional view taken on line 4—4 of FIG. 3.
Figure 5:
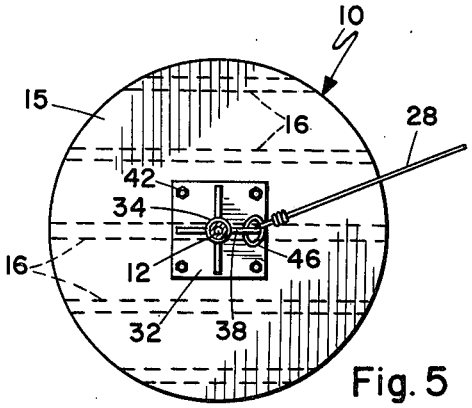
FIG. 5 is a sectional view taken on line 5—5 of FIG. 4.

Referring now to FIGS. 3 and 4, the specific configuration for the stabilizer disc with the spaced planar circular stabilizing elements 15 and 17 is illustrated. The circular elements 15 and 17 may suitably be of an appropriate grade of ¼ inch marine plywood. The spacer strips 16 may be of mahogany and extend substantially across the entire width of the disc at the location for the particular strip 16. In the illustrated embodiment the spacer strips are approximately 1 ½ inches in height and ¾ inches in width.

The stabilizer arm 12 is connected to the disc 15 through an adaptor plate 32. The adaptor plate includes a threaded receptacle 34 which receives the threaded end of the stabilizer arm 12. The receptacle 34 is connected to the adaptor plate 32 through flanges 38. Suitable hardware, protruding through holes in the base plate, and circular element 15, such as nuts and bolts 40 and 42 are utilized. One of the flanges 38 is penetrated by a hole 44 which receives a ring 46. The ring 46 is utilized for tying the bow line 28.

The pivot 14 includes a pair of spaced stanchions 50 and 52 supporting bearing elements 56 and 58 respectively. The central bearing member 60 is carried on a pivot pin 62 which is received in the bearing members 56 and 58. The clearance offset of clearance section 18 is illustrated as comprising structural elements welded on opposite sides of the pivotal member 60 and to stabilizer arm 12 respectively.

A plurality of suitable bolts secure the stanchions 50 and 52 to the deck 24 of vessel 20.

OPERATION

In use the stabilizer is normally retracted during mooring of the vessel and while the vessel is cruising underway. In the fishing grounds or when other appropriate site for stabilization is reached, the vessel is moored or allowed to drift with the surface current. The stabilizers are lowered from their retracted position to the position illustrated in solid lines in FIG. 2. The buoyancy of the combined stabilizer disc and attachment is sufficient to float the circular elements with approximately one quarter of the total surface area out of the water. This produces a self adjusting angulation for the relationship between the stabilizer disc and the vessel.

Ocean swells tend to induce a rolling action in the vessel by differentially lifting first one side of the vessel and then the opposite side as they pass the vessel. However, with the stabilizer in place the tendency of a swell to lift, for example, the left side of the vessel in the FIG. 1 is met with a countervailing force produced by the drag of stabilizer discs through the water. The ratio of length of the stabilizer arm to the height of the pivot 14 above the water line 70 is such that the stabilizer always has an adequate lever arm with which to transfer force to the vessel. At the same time the action of the pivot insures that no bending movement will be transferred to the stabilizer structure. Thus the pull drag on the left stabilizer reduces the tendency of the vessel to roll to the right, whereas the push drag on the opposite stabilizer accomplishes the same general effect.

Stabilizers may also be utilized with the vessel under way such as in trolling and in this operation the use of bow lines 28 is particularly effective in reducing stresses which would otherwise be transferred by the forward motion of the vessel through the water.

In the instant embodiment, the stabilizers are not stressed for high speed operation and they are therefore retracted when the vessel is operated at cruising speed. In the retracted position the stabilizer disc is above the normal cabin structure and the arm is in close proximity to the deck house structure 26 to minimize the interference with normal vessel operations.

Having described my invention, I now claim:

1. A roll stabilizer for reducing the swell induced rolling motion of a vessel in a body of water comprising:

a stabilizer disc means comprising a generally planer disc having a net buoyancy for floating said planer disc on a water surface and maintaining a major portion of said planar disc submerged, pivot means secured to the vessel at a point spaced above the nominal water line of said vessel, stabilizer arm means connected between said stabilizer disc and said pivot means for pivotal movement of said stabilizer disc about a generally horizontal axis in response to the passage of a swell, one of said stabilizer disc means being secured on each of the two opposite sides of the vessel.

2. A roll stabilizer for reducing the swell induced rolling motion of a vessel in a body of water according to claim 1 wherein;

the distance between said pivot axis and said disc means is substantially twice the distance of the pivot means above said nominal water line.

3. A roll stabilizer for reducing the swell induced rolling motion of a vessel in a body of water according to claim 1 wherein;

said disc is secured at substantially a right angle to said stabilizer arm.

4. A roll stabilizer for reducing the swell induced rolling motion of a vessel in a body of water according to claim 1 wherein;

said stabilizer disc is substantially at the amidships point of said vessel.

5. A roll stabilizer for reducing the swell induced rolling motion of a vessel in a body of water according to claim 4, further including:

a line extending from said disc means to the bow of said vessel.

6. A roll stabilizer for reducing the swell induced rolling motion of a vessel in a body of water according to claim 1, wherein;

said planar disc is substantially circular in planar configuration.

7. A roll stabilizer for reducing the swell induced rolling motion of a vessel in a body of water comprising:

a stabilizer disc means comprising first and second planar discs having a net buoyancy for floating said planar discs on a water surface and maintaining a major portion of said planar discs submerged, pivot means secured to the vessel at a point spaced above the nominal water line of the vessel, stabilizer arm means connected between said stabilizer disc means and said pivot means for pivotal movement of said stabilizer disc means about a generally horizontal axis in response to the passage of a swell, said second planar disc is supported spaced from said first planar disc forming a volume between said discs that is open for the admission of water.

8. A roll stabilizer for reducing the swell induced rolling motion of a vessel in a body of water according to claim 7 wherein:

the distance between said pivot means and said disc means is substantially twice the distance that said pivot means is above said nominal water line.

9. A roll stabilizer for reducing the swell inducing rolling motion of a vessel in a body of water according to claim 7 wherein:

said disc means is secured at substantially a right angle to said stabilizer arm.

10. A roll stabilizer for reducing the swell inducing rolling motion in a body of water according to claim 7 wherein:

said stabilizer disc means is substantially at the midships point of said vessel.

11. A roll stabilizer for reducing the swell induced rolling motion of a vessel in a body of water according to claim 10 further including:

the line extending from said disc means into the bow of said vessel.

12. A roll stabilizer for reducing the swell induced rolling motion of a vessel in a body of water according to claim 7 wherein:

said first and second planar discs are substantially circular in planar configuration.

13. A roll stabilizer for reducing the roll induced rolling motion of a vessel in a body of water according to claim 7 wherein:

said second planar disc is supported by a plurality of longitudinal spacers extending generally parallel to the fore and aft center line of the vessel.

* * * * *